US005215485A

United States Patent [19]

Bonner et al.

[11] Patent Number: 5,215,485

[45] Date of Patent: Jun. 1, 1993

[54] COVER FOR THE HOOD OF AN OUTBOARD MOTOR

[76] Inventors: Hugh Bonner, 14 Jupiter Bay, Winnipeg, Manitoba, Canada, R3T 0W6; Jerry Cousins, Box 3000, Lac Du Bonnet, Manitoba, Canada, R0E 1A0

[21] Appl. No.: 872,128

[22] Filed: Apr. 22, 1992

[51] Int. Cl.[5] ..... B63H 21/00

[52] U.S. Cl. ..... 440/77; 440/900

[58] Field of Search ..... 440/76, 77, 78, 113, 440/900; 441/65, 74; 123/195 P

[56] References Cited

U.S. PATENT DOCUMENTS

| | | | |
|---|---|---|---|
| 3,090,463 | 5/1963 | Yanda | 440/77 |
| 3,195,530 | 7/1965 | Heidner | 440/77 |
| 3,886,889 | 6/1975 | Burger | 440/113 |
| 4,850,914 | 7/1989 | Cox | 441/74 |
| 5,069,643 | 12/1991 | Westberg et al. | 440/77 |

FOREIGN PATENT DOCUMENTS

| | | | |
|---|---|---|---|
| 161692 | 9/1983 | Japan | 440/77 |

*Primary Examiner*—Joseph F. Peters, Jr.
*Assistant Examiner*—Stephen P. Avila
*Attorney, Agent, or Firm*—Adrian D. Battison; Stanley G. Ade; Murray E. Thrift

[57] ABSTRACT

The hood of an outboard motor is covered by a protective cover of a transparent plastics material which is self-supporting and resistant to UV degradation. The sheet forming the cover is molded to follow substantially exactly the contours of the hood so as to lie substantially wholly in contact therewith during use. The hood includes openings including a handle and other openings and the cover is molded with the same shape to follow the openings in the hood. The cover is attached underneath a resilient rubber rim at a bottom of the hood and is also attached to the hood by pinching between the hood and a separate handle insert.

19 Claims, 3 Drawing Sheets

1/3

COVER FOR THE HOOD OF AN OUTBOARD MOTOR

BACKGROUND OF THE INVENTION

This invention relates to a cover for the hood of an outboard motor.

Outboard motors for boats generally include a hood which is mounted on the housing of the motor so as to cover the underlying engine and to provide a pleasing and attractive appearance for the outboard motor. Generally the hood includes decals and logos which are provided to enhance the attractive appearance. The hood thus constitutes that part of the outboard motor which is immediately apparent to the eye with the remainder of the outboard motor being effectively utilitarian. For this reason the original manufacturer of the hood provides careful attention to ensure that the hood is attractively styled and provided with the markings, decals and logos which most effectively advertise and present their product.

Many such outboard motors are leased to operators of the equipment on a temporary basis for example for one season. Of course there is a tendancy where a product is not owned by the user that the product receives less careful attention during use and is thus much more prone to damage including marking, scratching or removal of the decals and logos which give the hood its attractive appearance. There is therefore a serious problem that the attractiveness of the equipment can be seriously deteriorated during only short usage for example during one season so that the value of the product is seriously reduced even though the operating parts may be still fully satisfactory.

Owners of such equipment therefore that is leased are often faced with significant cost to bring the product back up to its initial attractive appearance in order to obtain the repeated leasing of the product which is necessary to maximize financial return.

Covers for outboard motors generally comprise simply a flexible textile type covering which is wrapped around the hood and the upper part of the motor when not in use. Generally the cover is necessary to removed and accordingly it cannot in any way protect the motor when actually in operation. In addition of course there is a tendancy for the cover to be left off.

SUMMARY OF THE INVENTION

It is one object of the present invention, therefore, to provide an improved cover for an outboard motor.

According to the invention, therefore, there is provided a combination of a hood for an outboard motor and a protective cover mounted on the hood, the hood comprising a generally dome shaped molded body having a top wall and depending front, rear, left side and right side walls, the depending walls forming a contiguous lowermost edge, and a resilient rim member mounted on the lowermost edge, the body having at least one opening therein, the protective cover comprising a plastics sheet formed from a material having sufficient strength to be self supporting and being resistant to UY degradation and being transparent, the sheet being molded so as to follow substantially exactly the contours of outside surfaces of the hood, the cover having at least one opening therein coincident with said at least one opening in the hood, the cover extending over the top wall and the depending walls to a position of the cover underlying the rim member.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
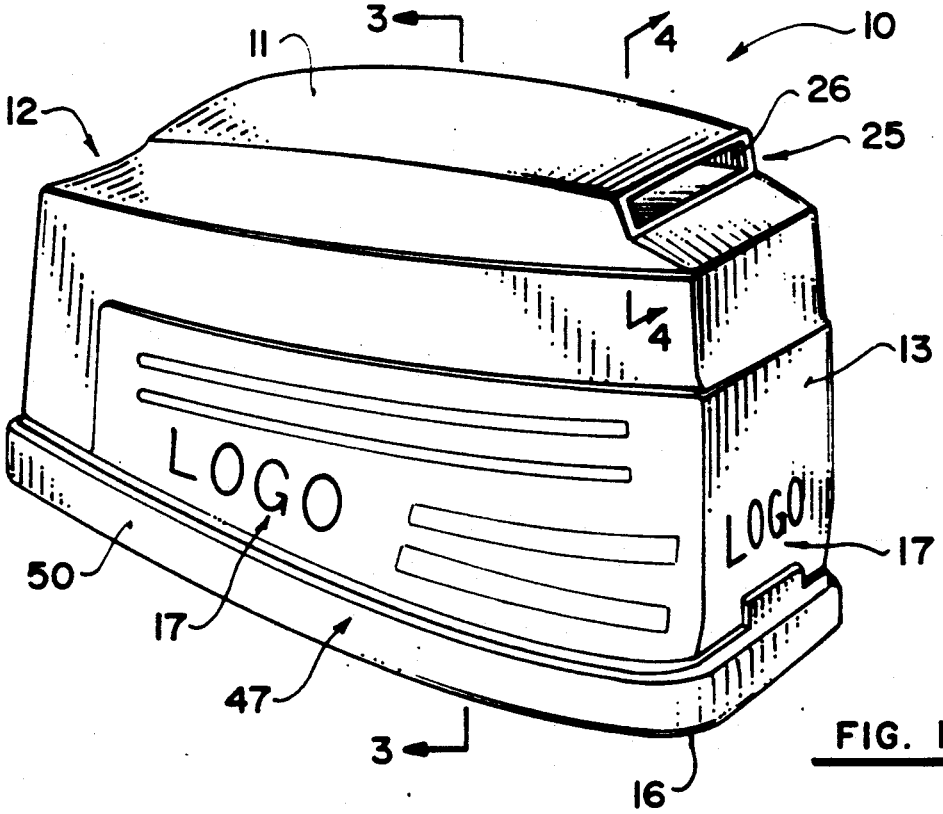
FIG. 1 is an isometric view of a hood including the cover of the present invention.
Figure 2:
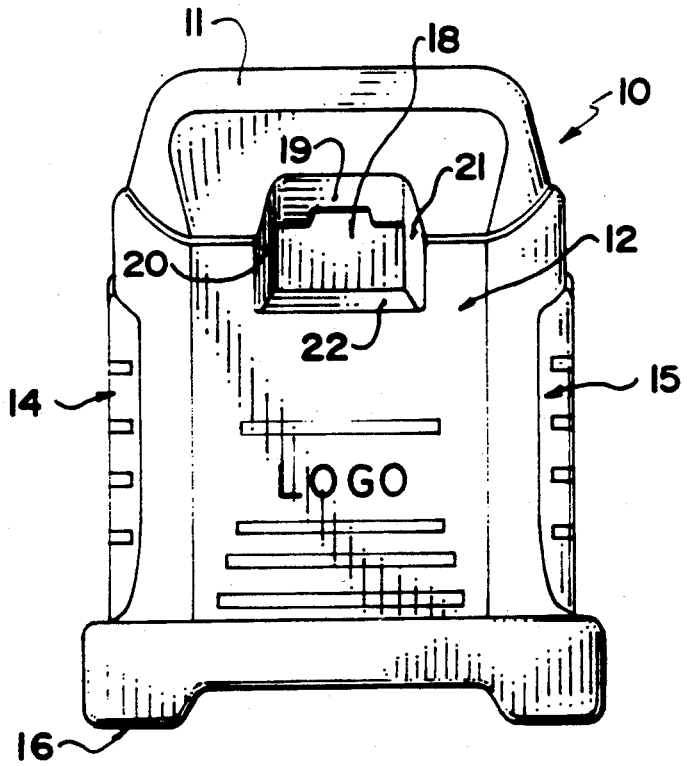
FIG. 2 is a front elevational view of the hood of FIG. 1.

The hood of FIGS. 1 and 2 is shown separated from the conventional motor to which it is intended to be attached. The hood comprises a generally dome shape body generally indicated at 10 including a top wall 11, a front depending wall 12, a rear depending wall 13, a left side wall 14 and a right side wall 15. The side walls depending downwardly to a contiguous edge 16 which surrounds the whole of the bottom dome shape body. This edge is intended to sit upon the upper edge of the conventional motor to which the hood is to be attached.

The hood includes various logos and markings and indicia generally indicated at 17 on various surfaces to provide an attractive appearance. The hood is designed with various curved and shaped surfaces interconnecting or forming part of the top wall and the depending walls so as again to provide an attractive and streamlined appearance while housing the shape of the parts of the motor underneath the hood.

The hood includes in the front wall 12 an opening 18 which is generally rectangular in elevation and is defined by a vertically depending wall portion 19 at a top of the opening, two vertically depending side wall portions 20 and 21 extending at right angles to the wall portion 19 and a horizontal wall portion 21 interconnecting( the bottoms of the side walls 20 and 22.

Figure 3:
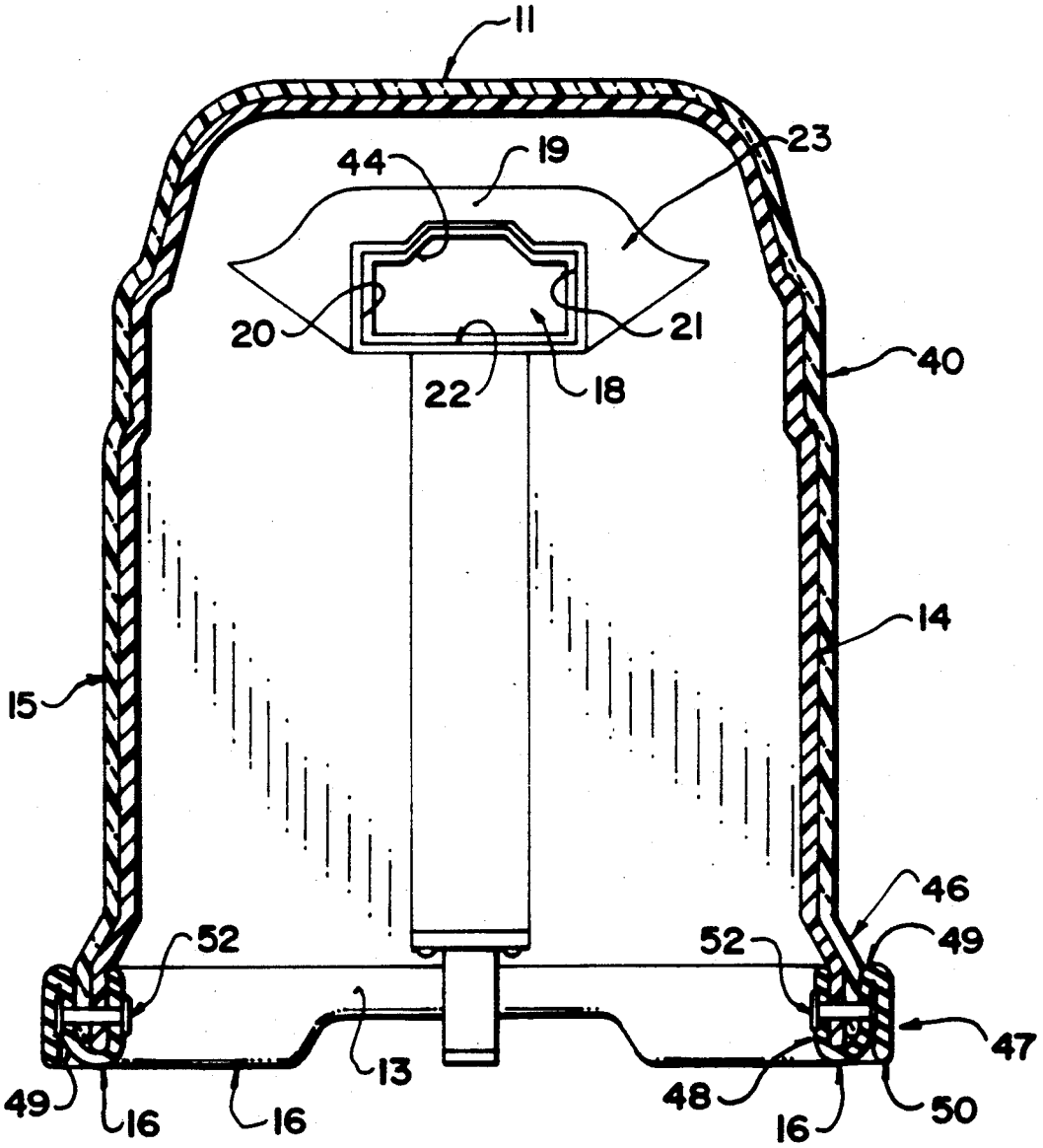
FIG. 3 is a cross sectional view along the lines 3—3 of FIG. 1.

The opening 18 is provided in the front of the hood to allow grasping of a pull cord by which the outboard motor can be started in conventional manner. As shown in FIG. 3, the wall portions 19, 20, 21, and 22 are reinforced relative to the interior of the hood by a web 23 which is connected across the interior of the hood.

Figure 4:
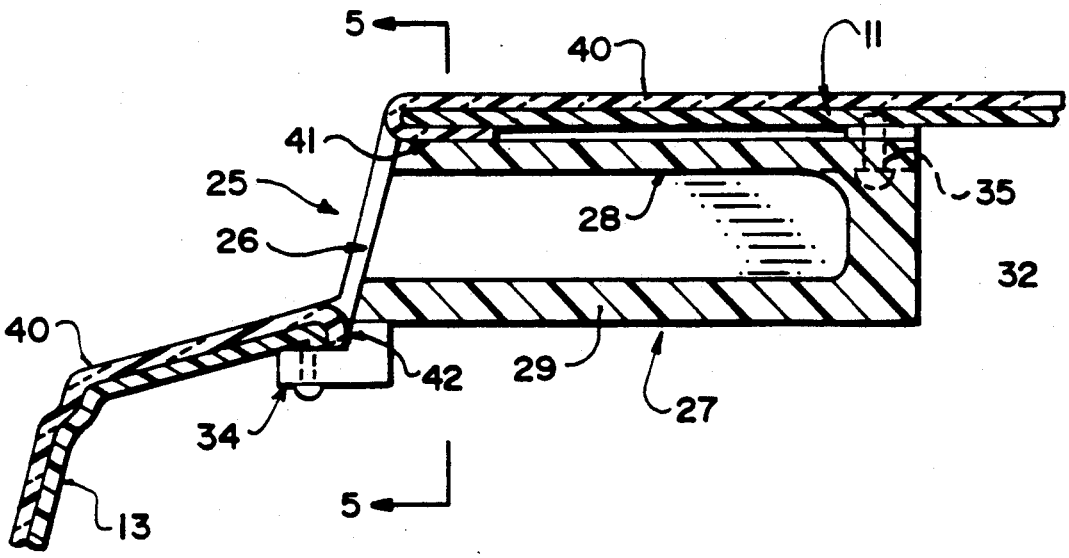
FIG. 4 is a cross sectional view along the lines 4—4 of FIG. 1.
Figure 5:
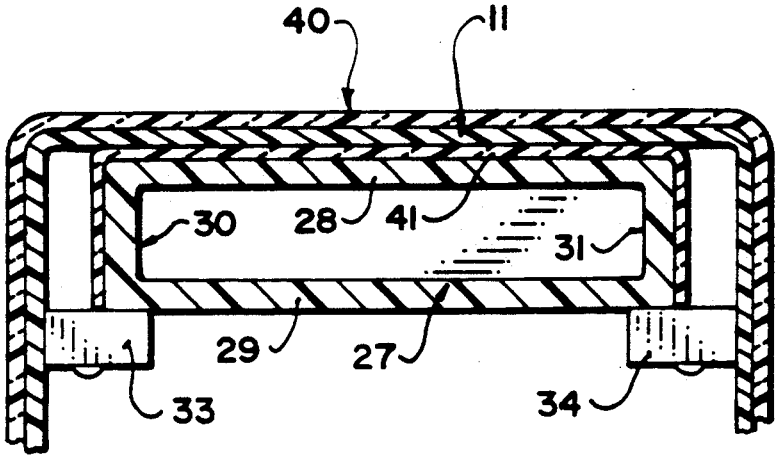
FIG. 5 is a cross sectional view along the lines 5—5 of FIG. 4.

On the top wall 11 adjacent the rear wall 13 is provided a handle generally indicated at 25. The handle is formed at an opening 26 in the wall of the hood, that opening being formed at a step in the upper wall so the opening lies generally in a vertical plane. A separate handle member 27 shown in FIGS. 4 and 5 is attached to the hood at the opening 26. The handle member 27 comprises a top wall 28, bottom wall 29, a first side wall 30, a second side wall 31, and a rear end 32 forming an open mouth and a channel into which the fingers of the user can be inserted. The handle member is attached to the hood so that the top wall 28 lies along the underside of the top wall of the hood and the bottom wall 29 terminates at a bottom edge of the opening 26. The handle is molded as a separate element and attached is a seperate element in order to provide structural strength at that area and in addition to avoid complex molding techniques of the hood thus avoiding rebate sections in the hood during molding of the hood itself.

The handle member is attached to the hood by a pair of tabs 33 and 34 at a forward end and by a pair of screw fasteners 35 at a rearward end which extend into recesses provided at the rear end 32 of the handle member.

The hood is covered by a molded sheet 40 of a plastics material which is molded so that it fits substantially exactly over all of the contours of the hood. The cover is formed with an opening coincident with the opening 18 and an opening coincident with the opening 26. At the opening 18, the cover is molded so that surfaces thereof lie directly along and in contact with the surfaces 19, 20, 21, and 22. At the edge of the cover at the opening 18, the cover is molded with a rolled or curved edge portion 44 which wraps around the edge of the respective wall portion at the opening.

At the opening 26, the cover is molded to form portions 41 and 42 which are turned under or around the edge of the cover wall itself so as to be pinched between the cover wall and the handle member.

As shown in FIG. 3, the bottom edge of the cover includes a portion 46 which reaches to a position at or closely adjacent the edge 16 of the hood. This edge portion 46 and the edge 16 are covered by a resilient rim member 47 in the form of a rubber strip which is folded to form an inside leg 48 which lies along the inside surface of the hood, an intermediate leg 49 which lies along the outside surface of the hood and the outside surface of the cover edge portion 46 and a downwardly depending leg 50 which forms the outermost strip of a rim member visible at the outer surface as shown in FIG. 1.

The inner and outer legs 48 and 49 are attached to the edge 16 and to the edge portion 45 by pop rivets 52 which pass through the legs and through the edge portions of the cover and the hood. The outer leg 50 is outside the pop rivets so that the pop rivet is not exposed as providing an attractive appearance as shown in FIG. 1.

In this way the cover is formed so that it is smoothly applied over the hood with contact or virtual contact over the whole of the hood and is held in place by the rim member and by the engagement with the handle so that it forms one unitary structure covering the whole of the hood with little danger of damage or tearing.

The cover is formed from a rigid PYC film of a type engineered for use in box folding applications. One example is known as BBFC manufactured by Nan Ya Plastics Corporation of Livingston, New Jersey. This product is designed so that it is resistant to UY degradation providing effective weather ability.

The cover is thus attached permanently to the hood so that it protects the logos and markings of the hood. It remains in place at all times during the use of the hood and can be replaced if it becomes damaged. It provides therefore a low cost protection for the hood.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A combination of a hood for an outboard motor and a protective cover mounted on the hood, the hood comprising a generally dome shaped molded body having a top wall and depending front, rear, left side and right side walls, the depending walls forming a contiguous lowermost edge, the top wall and depending walls together defining an outer surface of the molded body, and a resilient rim member mounted on the lowermost edge, the body having at least one opening therein, the protective cover comprising a plastics sheet formed from a material having sufficient strength to be self supporting and being resistant to UV degradation and being transparent, the sheet being molded so as to follow substantially exactly the contours of outside surfaces of the hood, the cover having at least one opening therein coincident with said at least one opening in the hood, the cover extending over the top wall and the depending walls to a position of the cover underlying the rim member, the cover having an inner surface lying in contact with substantially the whole of the outer surface of the molded body.

2. The combination according to claim 1 wherein the cover is attached to the hood at the rim member by fastener means passing through the rim member, an edge of the cover and the hood.

3. The combination according to claim 1 wherein the hood includes a handle member separate from said dome-shaped molded body and fastened thereto at one of said at least one opening, the cover including a portion thereof pinched between the handle member and adjacent portions of said generally dome-shaped molded body so as to attach the cover to said molded body at the handle member.

4. The combination according to claim 3 wherein the handle member is arranged adjacent the rear depending wall and wherein there is provided a second one of said at least one opening at the front depending wall.

5. The combination according to claim 1 wherein the hood includes an opening in one of said depending walls and includes wall portions thereof at said opening in said one of said depending wall which wall portions are turned inwardly generally at right angles to said one of said depending walls and wherein the cover is shaped to follow said wall portions.

6. The combination according to claim 5 wherein edges of the cover at said opening are curved inwardly.

7. The combination according to claim 1 wherein the cover is formed from a rigid PVC film.

8. A combination of a hood for an outboard motor and a protective cover mounted on the hood, the hood comprising a generally dome-shaped molded body having a top wall and depending front, rear, left side and right side walls, the depending walls forming a contiguous lowermost edge, and a resilient rim member mounted on the lowermost edge, the body having at least one opening therein, the protective cover comprising a plastics sheet formed from a material having sufficient strength to be self supporting and being resistant to UV degradation and being transparent, the sheet being molded so as to follow substantially exactly the contours of outside surfaces of the hood, the cover having at least one opening therein coincident with said at least one opening in the hood, the cover extending over the top wall and the depending walls to a position of the cover underlying the rim member, wherein the hood includes a handle member separate from said dome-shaped molded body and fastened thereto at one of said at least one opening, the cover including a portion thereof pinched between the handle member and adjacent portions of said molded body so as to attach the cover to said molded body at the handle member.

9. The combination according to claim 8 wherein the cover is attached to the hood at the rim member by fastener means passing through the rim member, an edge of the cover and the hood.

10. The combination according to claim 8 wherein the handle member is arranged adjacent the rear depending wall and wherein there is provided a second one of said at least one opening at the front depending wall.

11. The combination according to claim 10 wherein the hood includes wall portions thereof at said opening in the front depending wall which wall portions are turned inwardly generally at right angles to the front depending wall and wherein the cover is shaped to follow said wall portions.

12. The combination according to claim 11 wherein edges of the cover at the opening are curved inwardly.

13. The combination according to claim 8 wherein the cover is formed from a rigid PVC film.

14. A combination of a hood for an outboard motor and a protective cover mounted on the hood, the hood comprising a generally dome-shaped molded body having a top wall and depending front, rear, left side and right side walls, the depending walls forming a contiguous lowermost edge, and a resilient rim member mounted on the lowermost edge, the body having at least one opening therein, the protective cover comprising a plastics sheet formed from a material having sufficient strength to be self supporting and being resistant to UV degradation and being transparent, the sheet being molded so as to follow substantially exactly the contours of outside surfaces of the hood, the cover having at least one opening therein coincident with said at least one opening in the hood, the cover extending over the top wall and the depending walls to a position of the cover underlying the rim member, wherein the hood includes an opening in one of said depending walls and includes wall portions thereof at said opening in the depending wall which wall portions are turned inwardly generally at right angles to the front depending wall and wherein the cover is shaped to follow said wall portions.

15. The combination according to claim 14 wherein the cover is attached to the hood at the rim member by fastener means passing through the rim member, an edge of the cover and the hood.

16. The combination according to claim 14 wherein the hood includes a handle member separate from the generally dome-shaped molded body and fastened thereto at one of said at least one opening, the cover including a portion thereof pinched between the handle member and adjacent portions of said molded body so as to attach the cover to said molded body at the handle member.

17. The combination according to claim 16 wherein the handle member is arranged adjacent the rear depending wall and wherein there is provided a second one of said at least one opening at the front depending wall.

18. The combination according to claim 14 wherein edges of the cover at the opening are curved inwardly.

19. The combination according to claim 14 wherein the cover is formed from a rigid PVC film.

* * * * *